US006023957A

United States Patent [19]

Minnerop

[11] Patent Number: 6,023,957

[45] Date of Patent: Feb. 15, 2000

[54] UNIVERSAL ROLL STAND WITH A DIVIDED HOUSING ON THE OPERATOR SIDE

[75] Inventor: Michael Minnerop, Ratingen, Germany

[73] Assignee: SMS Schloemann-Siemag Aktiengesellschaft, Düsseldorf, Germany

[21] Appl. No.: 09/281,445

[22] Filed: Mar. 30, 1999

[30] Foreign Application Priority Data

Apr. 11, 1998 [DE] Germany ..... 198 16 320

[51] Int. Cl.[7] ..... B21B 13/10

[52] U.S. Cl. ..... 72/225

[58] Field of Search ..... 72/225, 224, 237, 72/238, 239, 248, 245

[56] References Cited

U.S. PATENT DOCUMENTS 3,948,072 4/1976 Aramaki ..... 72/225

4,095,448 6/1978 Gipperich ..... 72/238

4,715,206 12/1987 Forni ..... 72/225

FOREIGN PATENT DOCUMENTS 0178462 4/1986 European Pat. Off. .

*Primary Examiner*—Joseph J. Hail, III

*Assistant Examiner*—Rodney Butler

*Attorney, Agent, or Firm*—Friedrich Kueffner

[57] ABSTRACT

A universal roll stand with a divided housing on the operator side, wherein a vertical housing stirrup engages between the upper and lower separating lines or planes of separation of the housing. A transfer element overlapping the two separating lines for transmitting the vertical forces between the upper and lower housing parts is arranged in each lateral housing groove arranged on both sides of the roll housing on the operator side.

4 Claims, 2 Drawing Sheets

UNIVERSAL ROLL STAND WITH A DIVIDED HOUSING ON THE OPERATOR SIDE

BACKGROUND OF THE INVENTION

1. Field of the Invention

The present invention relates to a universal roll stand with a divided housing on the operator side, wherein a vertical housing stirrup engages between the upper and lower separating lines or planes of separation of the housing.

2. Description of the Related Art

Universal stands of this type make possible a simple exchange of the roll sets because, for example, after opening of the vertical housing stirrup and/or moving away of the roll housing on the operator side, the universal roll set is exposed for assembly and disassembly with the aid of a roll exchange carriage. However, there are problems with respect to the high forces which act between the roll housings on the drive side and on the operator side in the horizontal and vertical directions and which must be transmitted at the lines or planes of separation.

EP A1 0 178 462 discloses a two-high stand in which the horizontal forces occurring in the stand are absorbed by hydraulically tensioned tension members which are hinged to the roll housing, so that they can be swung in and out and which, in the swung-in state are immersed or located in longitudinal recesses which are open in the rolling direction.

SUMMARY OF THE INVENTION

Therefore, it is the primary object of the present invention to construct a universal roll stand of the above-described type in such a way that the high vertical and horizontal forces can be absorbed.

In accordance with the present invention, a transfer element overlapping the two separating lines for transmitting the vertical forces between the upper and lower housing parts is arranged in each lateral housing groove arranged on both sides of the roll housing on the operator side.

Accordingly, while the horizontal forces are absorbed in the same manner as in the known two-high stand by the hydraulically pretensioned tension members, the high vertical forces are transferred beyond the separating lines to the two housing parts by the transfer elements which are subjected to shearing load and pressure load.

In accordance with a preferred embodiment of the invention, the transfer elements, which are preferably constructed as push or thrust blocks, are flexibly fastened to the tension members which can be swung into the housing grooves. Instead of using the otherwise required additional adjusting cylinders, the present invention provides that the tension members which are required in any event are simultaneously used for swinging the transfer elements in and out. The flexible fastening is understood to be the fact that no pushing or shearing forces are transferred by the transfer elements into the tension member during rolling. Consequently, it is proposed that the transfer elements are fastened with play to the tension members through holding clamps. Accordingly, the holding clamps provide the necessary slight play between the tension members and the transfer elements.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
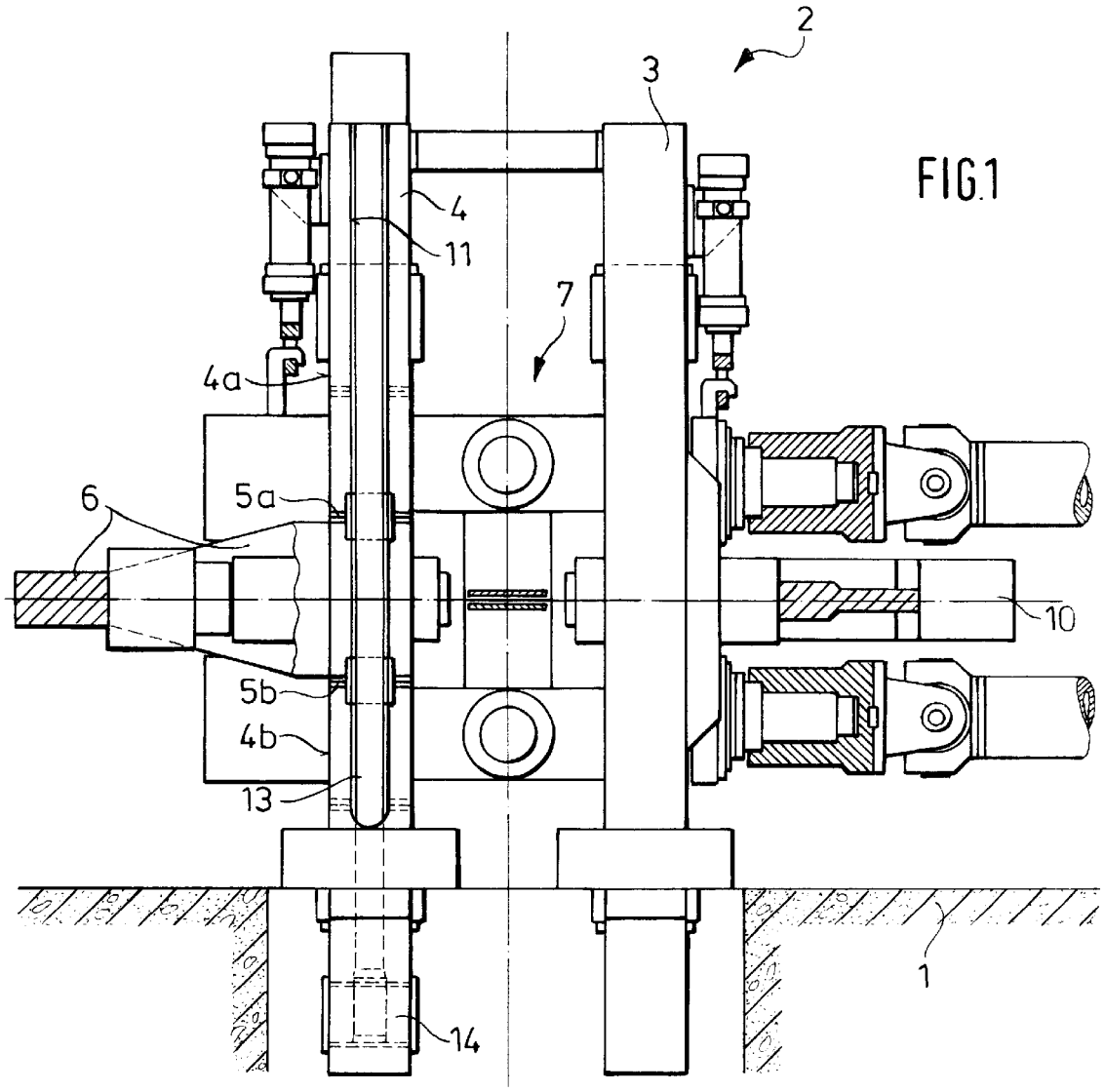
FIG. 1 is a complete elevational view, partially in section, of a universal roll stand seen in the rolling direction.
Figure 2:
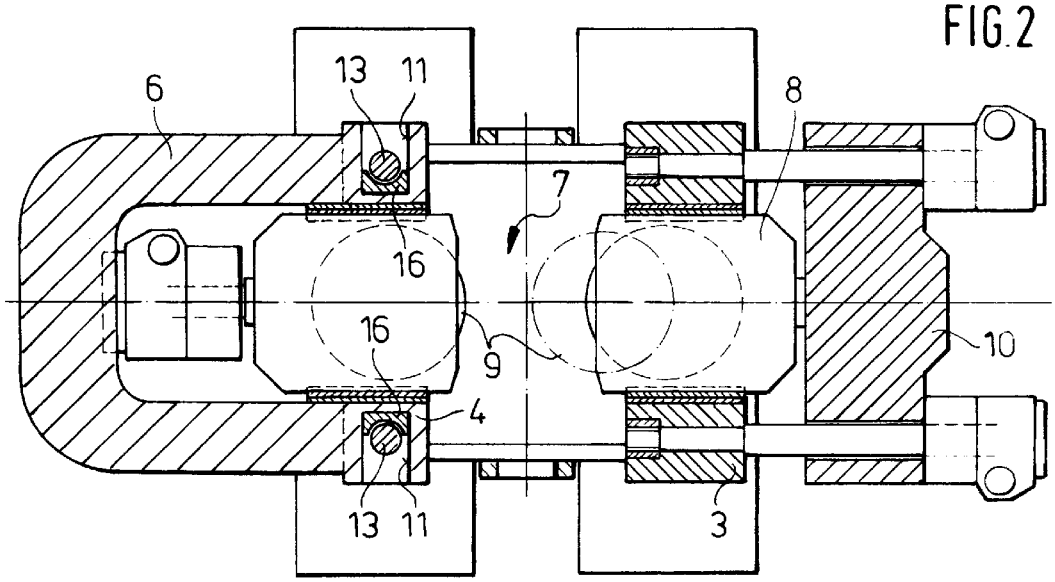
FIG. 2 is a top view, partially in section, of the roll stand of FIG. 1.

A universal roll stand 2 anchored in a foundation 1 has a closed roll housing 3 on the drive side and a divided roll housing 4 on the operator side with an upper part 4*a* and a lower part 4*b*. The two housing parts 4*a*, 4*b* of the open roll housing 4 on the operator side are connected to each other through a vertical housing stirrup 6 which engages between the upper and lower separating lines 5*a*, 5*b*. The roll set 7 which includes the horizontal rolls as well as the vertical rolls is supported with a chock 8 of the vertical rolls 9 at a crossbeam 10 of the oppositely located roll housing 3 on the drive side.

Figure 3:
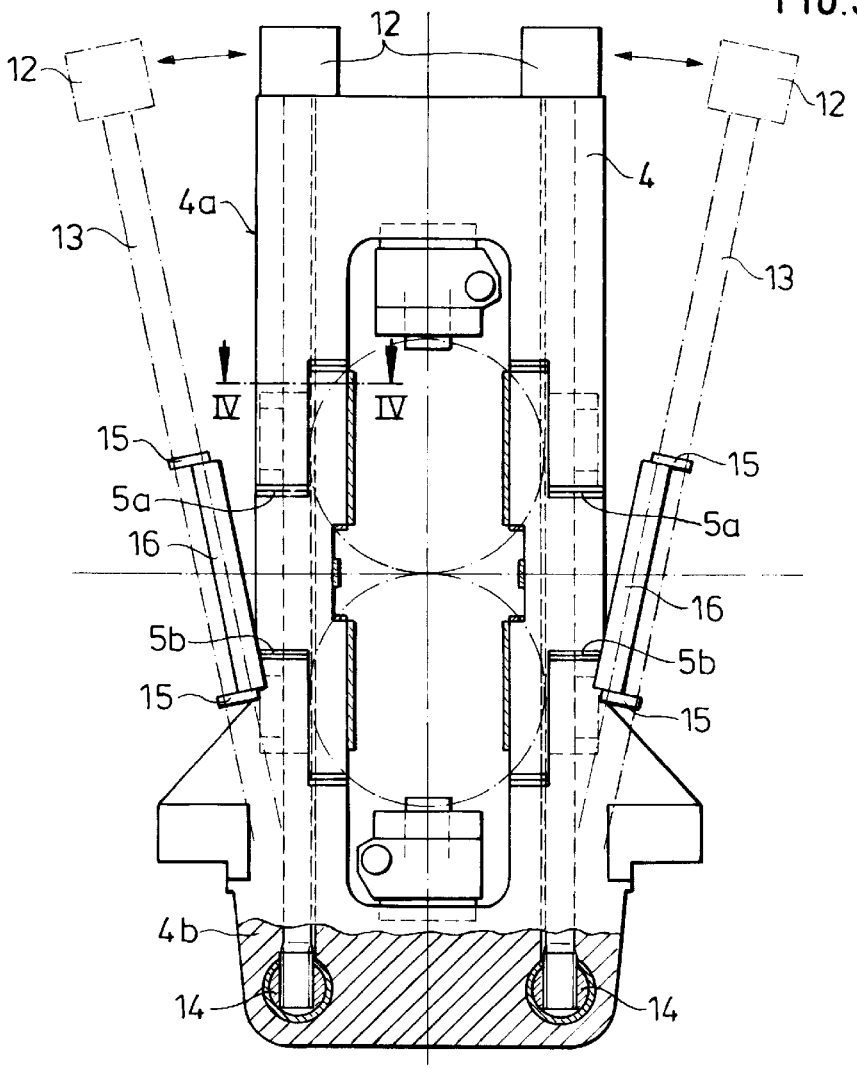
FIG. 3 is a side view, partially in section, seen from the operator side, i.e., from the left as seen in the drawing of the universal roll stand of FIG. 1.
Figure 4:
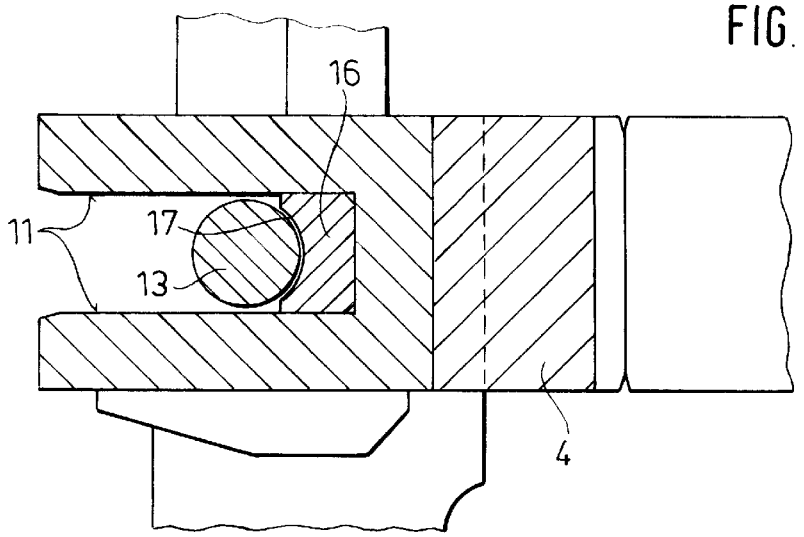
FIG. 4 is a sectional view, on a larger scale, taken along sectional line IV—IV of FIG. 3.

Tension members 13 equipped with integrated tensioning cylinders 12 are mounted so as to be swingable into housing grooves 11 extending on the outer sides over the entire length of the roll housing 4 on the operator side, wherein the position in which the tension members 13 are swung out of the housing grooves 11 is shown in dash-dot lines in FIG. 3. In order to make the tension members 13 swingable for the required roll exchange, the tension members 13 are mounted in circular grooves 14 of the lower part 4*b* of the housing.

As schematically indicated in FIG. 3, a block-like transfer element 16 is flexibly fastened by means of holding clamps 15 to the respective tension member 13; flexible is understood to mean with a slight play, i.e, a gap 17 exists between the tension member 13 and the transfer element 16. The transfer elements 16 have such a length and are arranged at the tension members 13 in such a way that, in the position in which they are swung in into the position of operation, they overlap upwardly and downwardly the separating lines or planes 5*a*, 5*b* of the roll housing 4 which opens toward the operator side. During operation, the hydraulically pretensioned tension members 13 absorb the horizontal forces, and the transfer elements or blocks 16, which are under shearing load and pressure load, transfer the vertical forces to the upper and lower housing parts 4*a* and 4*b*, respectively.

In order to make it easier to swing in the tension member 13 with the transfer elements 16 mounted thereon, the size of the housing grooves 11 is slightly greater (about 1 mm) than the width of the transfer elements 16. In order to still be able to secure the transfer elements 16 in the housing grooves 11 in a fixed or balanced manner and, thus, to eliminate the play with which the components are mounted in the direction of the flow of the force, the roll exchange carriage, not shown, once again applies a force on the vertical housing stirrup 6 after the tension members 13 have been swung in. This makes it possible to produce a force which places the transfer elements in contact with the housing grooves 11 in the direction of the flow of the force, i.e., in the direction of the vertical rolling force. Only then are the tension members 13 pretensioned by means of the tensioning cylinders 12, so that the position of the transfer elements 16 is fixed.

Consequently, together with the pretensioned tension members 13, the transfer elements or blocks 16 which are arranged in the housing grooves 11 and overlap the separating lines 5*a* and 5*b* toward the top as well as toward the bottom, ensure that the high forces occurring in a universal roll stand in the horizontal and vertical directions can be absorbed and transferred.

While specific embodiments of the invention have been shown and described in detail to illustrate the inventive principles, it will be understood that the invention may be embodied otherwise without departing from such principles.

I claim:

1. A universal roll stand comprising a housing on an operator side, the housing being divided at separating lines into an upper housing part and a lower housing part, tension members for tensioning the housing, a vertical housing stirrup engaging between the upper and lower separating lines, further comprising a transfer element each mounted in lateral housing grooves provided on two sides of the roll housing, wherein the transfer elements are mounted so as to overlap the upper and lower separating lines for transferring vertical forces between the upper and lower housing parts.

2. The universal roll stand according to claim 1, wherein the tension members are mounted so as to be swingable into and out of the housing grooves, and wherein the transfer elements are flexibly fastened to the tension members.

3. The universal roll stand according to claim 2, wherein the transfer elements are comprised of shearing blocks.

4. The universal roll stand according to claim 2, wherein the transfer elements are fastened with play to the tension members with holding clamps.

* * * * *